US007198212B2

(12) United States Patent
Kato et al.

(10) Patent No.: US 7,198,212 B2
(45) Date of Patent: Apr. 3, 2007

(54) SHEET SHREDDER

(75) Inventors: Takuji Kato, Kanagawa-ken (JP); Junichi Inoue, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 99 days.

(21) Appl. No.: 11/063,964

(22) Filed: Feb. 24, 2005

(65) Prior Publication Data

US 2005/0199756 A1 Sep. 15, 2005

(30) Foreign Application Priority Data

Mar. 9, 2004 (JP) ..... 2004-066111

(51) Int. Cl.
*B02C 18/16* (2006.01)

(52) U.S. Cl. ..... 241/57; 241/65; 241/166; 241/236

(58) Field of Classification Search ..... 241/166, 241/167, 236, 295, 65, 62, 57
See application file for complete search history.

(56) References Cited

U.S. PATENT DOCUMENTS 2,770,302 A * 11/1956 Lee ..... 83/114
4,688,730 A 8/1987 Dahle
5,636,801 A * 6/1997 Kroger ..... 241/167

FOREIGN PATENT DOCUMENTS

| | | |
|---|---|---|
| EP | 0 607 564 A2 | 7/1994 |
| EP | 0 607 564 A3 | 7/1994 |
| JP | 2002-192002 | 7/2002 |

* cited by examiner

*Primary Examiner*—Mark Rosenbaum
(74) *Attorney, Agent, or Firm*—Pillsbury Winthrop Shaw Pittman, LLP

(57) ABSTRACT

The sheet shredder includes a cutter block pair equipped with plural cutter discs arranged in parallel with each other at a specified distance, cutting units to cut sheets by rotating the cutter discs of the cutter block pair in the different directions respectively, guide plates to guide cut pieces of sheets cut by the cutter discs in the specified direction, and grooves provided at the sides opposite to the cutter discs of the guide plates to lead out stickum adhered to the cutter discs or the guide plates pursuant to the sheet cutting operation.

7 Claims, 4 Drawing Sheets

SHEET SHREDDER

CROSS-REFERENCE TO RELATED APPLICATION

This application is based upon and claims the benefit of priority from the prior Japanese Patent Application No. 2004-66111 filed on Mar. 9, 2004; the entire contents of which are incorporated herein by reference.

BACKGROUND OF THE INVENTION

1. Field of the Invention

This invention relates to a sheet shredder, which cuts sheets such as, for example, banknotes, securities, etc. in pieces.

2. Description of the Related Art

As shown in the Japanese Patent Application Publication No. 2002-192002, this sheet shredder has a pair of cutter blocks equipped with plural cutter disc arranged in parallel with each other at a specified distance and cuts sheets by rotating this pair of cutter discs in different directions.

Further, guide plates are provided between plural cutter discs, respectively and cut pieces are guided into a collecting box by these guide plates.

There may be sheets to be cut that are mended, for example, partly torn banknotes that are mended by bonding with an adhesive tape. A stickum peeled off from this adhesive tape may adhere to the cutter disc of the shredder and/or the guide plates. In this case, a large load torque is gradually given to the rotation of the cutter disc. Because of this, there is a problem that the cutter disc and the guide plates must be cleaned frequently.

Further, when the operation is started again after the shredder is stopped and it was once cooled, a stickum are in the bonded state and load torque becomes extremely large. As a result, there was such an adverse consequence that the cutter disc may not turn as expected during the turning or when starting to turn and the shredding function drops.

SUMMARY OF THE INVENTION

An object of this invention is to provide a sheet shredder which is capable of reducing amount of adding stickum stuck to the cutter disc and guide palates and preventing stickum from firmly fixing.

According to an embodiment of this invention, there is provided a sheet shredder comprising a cutting unit equipped with a cutter block pair having plural cutter discs arranged in parallel with each other at a specified distance to cut sheets by rotating the cutter discs of the cutter block pair in the directions different each other; guide plates provided between the plural cutter discs to guide cut pieces of sheets cut by the cutter discs; and plural lead-out portions provided at the sides opposite to the cutter discs to lead out stickum adhered to the cutter discs or guide plates pursuant to the sheet cutting operation to the outside.

DETAILED DESCRIPTION OF THE EMBODIMENTS

Figure 1:
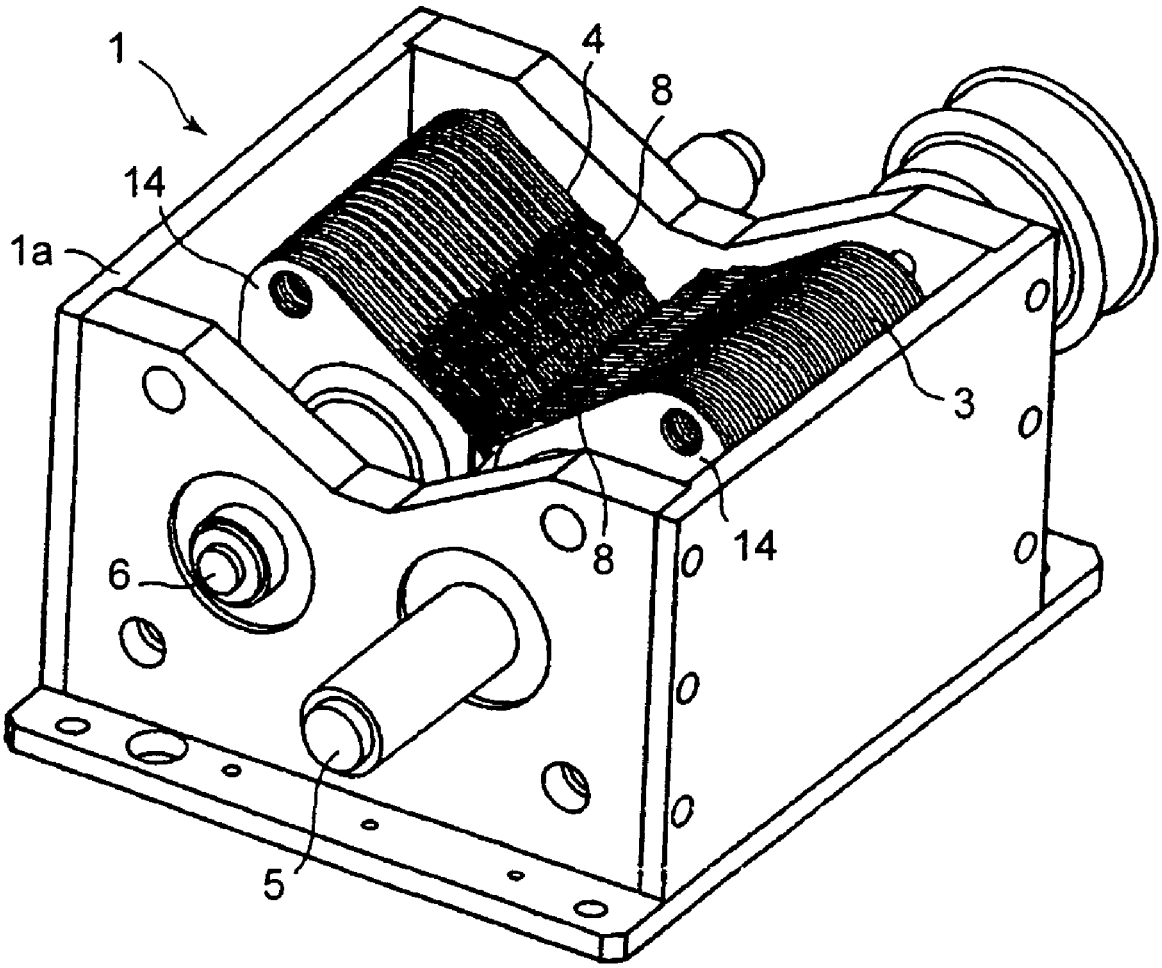
FIG. 1 is a perspective view showing a sheet shredder that is an embodiment of this invention.
Figure 2:
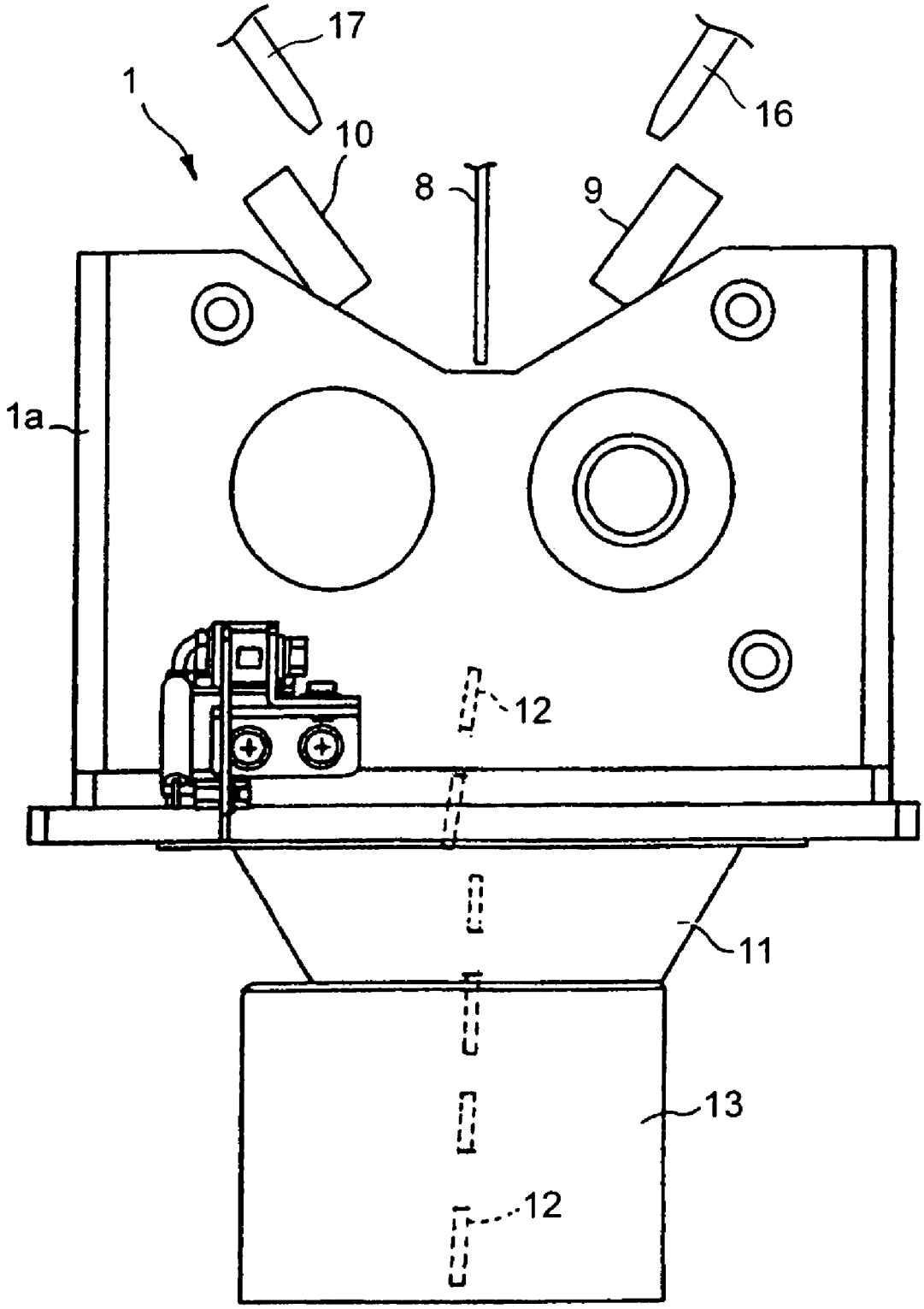
FIG. 2 is a front view of the sheet shredder shown in FIG. 1.
Figure 3:
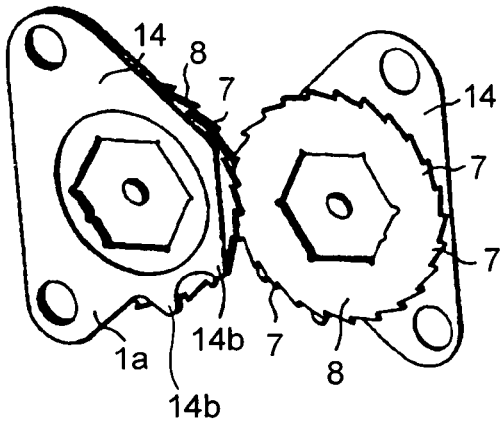
FIG. 3 is a perspective view showing cutter discs and guide plates of the sheet shredder shown in FIG. 1.
Figure 4:
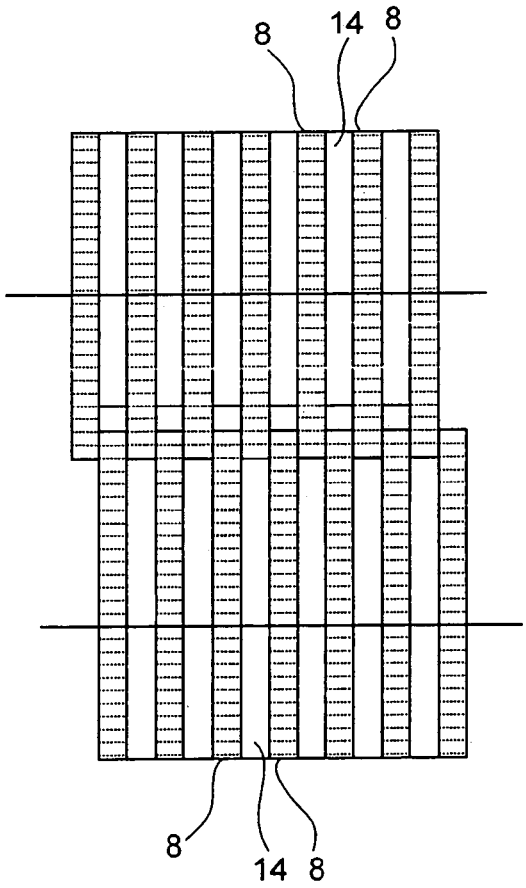
FIG. 4 is a top view showing the cutter discs and the guide plates of the sheet shredder shown in FIG. 1.

Embodiments of the sheet shredder of this invention will be described below in detail referring to the drawings. FIG. 1 is a perspective view showing the sheet shredder that is one embodiment of this invention and FIG. 2 is its front view.

A shredder 1 has a housing 1*a* of which upper surface and bottom surface are opened and in this housing 1*a*, cutter block pair (cutting unit) 3 and 4 are arranged facing each other as cutter block pairs. On the upper side of housing 1*a*, a pair of hot air blowing heaters 9 and 10 are arranged as preheating means for spraying hot air to cutter block pairs 3 and 4. At the lower side of the housing 1*a*, a collecting box 13 is provided to contain cut pieces 12 through a duct 11.

At the rotation centers of cutter blocks 3 and 4, shafts 5 and 6 to transmit the rotating force from a rotary driving mechanism (not shown) to cutter blocks 3 and 4 are provided, respectively. Plural sheets of cutter disc 8 as cutting blades are attached to shafts 5 and 6. On the circumferential edge of cutter discs 8, cutting teeth 7 are formed. Further, cutter disc 8 is 1.424 mm thick.

Shafts 5 and 6 are formed in polygonal shape, for example, a hexagonal pole and when they are rotated, cutter disc 8 is rotated integrally with them. Further, cutter discs 8 are incorporated in the state able to slide in the axial direction of shafts 5 and 6.

Further, on shredder 1, cutter blocks 3 and 4 equipped with cutter discs 8 of which cutting teeth 7 rotating in different direction are arranged alternately so that their rotating trajectories cross each other. Thus, it becomes possible to make a so-called vertical cutting.

Further, shredder 1 is provided with guide plates 14 to feed sheet 2 that is a cutting object into the shredder and to guide cut pieces 12 that are cut by cutting teeth 7 into collecting box 13.

Further, nozzles 16 and 17 are provided to feed air through the sheet 2 taken-in side (the upper side) in order to prevent cut pieces 12 from being rolled up by the rotation of cutter discs 8. Further, cut pieces 12 are certainly housed in collecting box 13 by air fed through nozzles 16 and 17.

Further, at the lower portions of guide plates 14, a projection pair 14*b* is formed to prevent cut pieces 12 from being blown up.

When an excessive friction is generated between cutting teeth 7 and sheet 2 and the cutting resistance increases; that is, a rotating load on cutter block 3 and 4 which are reverse rotated each other becomes above a certain level, an overload protection device provided as a limiter is actuated and shredder 1 is stopped to operate.

Figure 5:
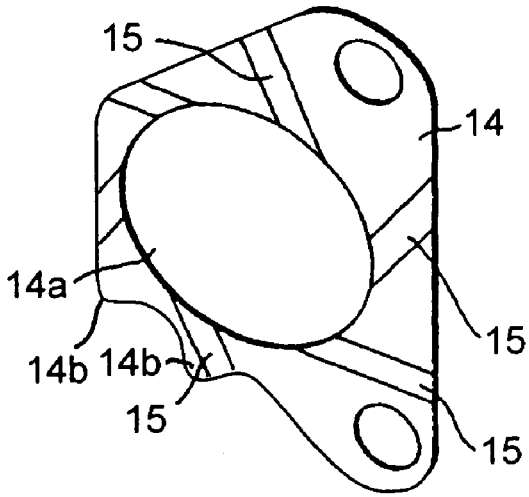
FIG. 5 is a perspective view showing the guide plates of the sheet shredder shown in FIG. 1.

FIG. 5 is a perspective view showing guide plates 14. On the sides of guide plates 14 opposing to cutter discs 8, plural concave shape hollow-ground cross-sectional grooves 15 are formed as lead-out grooves. On the central portions of guide plates 14, a circular shaped opening 14*a* is formed and the grooves 15 are formed extending to the outer edges of guide plates 14 from the inner edge of opening 14*a* in the tangential rotating direction of cutter discs 8. As a result of grooves 15 formed extending in the tangential rotating direction of cutter discs 8, when cutter discs 8 with stickum adhered thereon, stickum is lead out to the outer direction from the insides of grooves 15 by the centrifugal force. Further, the grooves 15 are formed in the widths narrower than widths of cut pieces 12, or the width of the cutter discs 8 which defines the width of cut pieces 12. Cut pieces are 1.5 to 2 mm wide and 10 to 15 mm long. Thus, cut pieces 12 can be prevented to enter into grooves 15.

In the above-described construction, when sheet 2 is cut, a hot air is blown against cutter block pair 3 and 4 in advance by hot air blowing heaters 9 and 10. After this pre-heating, sheet 2 is put into shredder 1 from the upper side. This input sheet 2 is sent between rotating cutter block pair 3 and 4 and cut into pieces. These cut pieces 12 are guided toward duct 11 by guide plates 14 and housed in collecting box 13 through duct 11.

Figure 6:
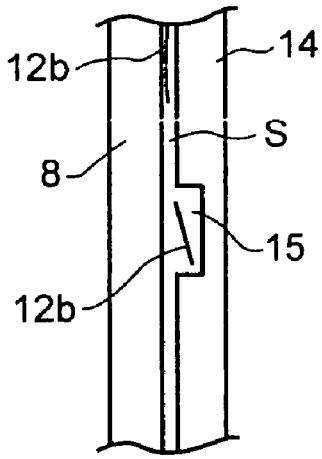
FIG. 6 is a cross sectional view partially showing the cutter disc and the guide plates of the sheet shredder shown in FIG. 1.

A stickum 12*b* of adhesive tape may be adhered to this cut sheet 2 for bonding broken sheet 2. This stickum 12*b* may attach to cutter discs 8 and guide plates 14 pursuant to the cutting operation and tend to stick in a gap S between cutter disc 8 and guide plate 14 as shown in FIG. 6

However, as there are plural grooves 15 formed on the surfaces of guide plates 14, stickum 12*b* is moved in the rotating direction of cutter discs 8 by its rotation and dropped in grooves 15 of guide plates 14 and lead out the outside along this grooves 15.

Accordingly, it is possible to reduce adhesion of stickum 12*b* in gap S between cutter disc 8 and guide plates 14 and to decrease a load torque applied on cutter discs 8. Thus, the shredding operation is made stable and cleaning frequencies for maintenance also can be reduced.

Further, because cutter block pair 3 and 4 is preheated by blowing hot air against them by hot air blowing heaters 9 and 10 prior to the shredding of sheet 2, even when stickum 12*b* is fixed in gap S, it is possible to soften stickum 12*b* and reduce a starting torque.

Further, this invention is not limited to the above-mentioned one embodiment, a roll paper for cleaning may be automatically supplied to cutter discs 8 for cleaning. According to this, it becomes possible to reduce again gradually increasing load torque and reduce frequencies of maintenance cleaning.

Further, shredder 1 may be constructed in such a structure that cutter discs 8 and guide plates 14 are provided in the state movable in the direction to contact and separate each other so that gap S between them can be adjusted. In this structure, by making gap S between cutter discs 8 and guide plates 14 large, it becomes possible to reduce a starting torque even when there are stickum between current discs 8 and guide plates 14.

Further, a flywheel may be provided to cutter discs 8. In this structure, even when a large load change is generated momentarily by a broken sheet mended with adhesive tapes, the influence to the cutter discs by the load change can be relieved.

Further, guide plates 14 can be provided in the movable state at a specified angle so as to rotate them periodically at a specified angle at a time. In this structure, it becomes possible to move the worn points of guide plates 14 and the life of the guide plates 14 can be extended.

Further, the various controls described above can be made, for example, by constantly monitoring load changes of cutter discs 8 by measuring a current value flowing through the driving motor.

Needless to say, this invention is applicable by modifying variously without departing from the spirit and scope thereof.

What is claimed is:

1. A sheet shredder comprising:

a cutting unit equipped with a cutter block pair having plural cutter discs arranged in parallel with each other at a specified distance to cut sheets by rotating the cutter discs of the cutter block pair along directions different each other;

guide plates provided between the plural cutter discs to guide cut pieces of sheets cut by the cutter discs; and plural lead-out portions provided at the sides opposite to the cutter discs to lead out stickum adhered to the cutter discs or guide plates pursuant to the sheet cutting operation to the outside, wherein the lead-out portions are formed in concave shape hollow ground cross-sectional grooves formed on the guide plates, and the width of the grooves is configured to be narrower than width of the cut piece or the width of the cutter discs that defines the width of cut pieces.

2. The sheet shredder as claimed in claim 1, wherein the grooves formed on the guide plates are in the tangential rotating direction of the cutter discs.

3. The sheet shredder as claimed in claim 1, wherein the grooves formed on the guide plates are extending to the outer edges of the guide plates.

4. The sheet shredder as claimed in claim 1, wherein the guide plates are provided rotatably by a specified angle at a time.

5. The sheet shredder as claimed in claim 1, further comprising: pre-heating means to preheat the cutter discs prior to the sheet cutting operation.

6. The sheet shredder as claimed in claim 5, wherein the pre-heating means includes a hot air blowing heater.

7. The sheet shredder as claimed in claim 1 further comprising: a nozzle provided to send air downward from the top of the cutting unit.

* * * * *